US006809707B1

(12) United States Patent
Holtslag

(10) Patent No.: US 6,809,707 B1
(45) Date of Patent: Oct. 26, 2004

(54) DISPLAYING INTERLACED VIDEO ON A MATRIX DISPLAY

(75) Inventor: Antonius H. M. Holtslag, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/268,253

(22) Filed: Mar. 15, 1999

(30) Foreign Application Priority Data

Aug. 12, 1998 (EP) ..... 98202701

(51) Int. Cl.[7] ..... G09G 3/28
(52) U.S. Cl. ..... 345/60; 315/169.4
(58) Field of Search ..... 345/87, 97, 98, 345/99, 100, 60–68, 76, 74.1; 348/790, 792, 793, 60, 77, 84; 315/167–169.1, 169.4; 313/481, 491, 514, 517, 520

(56) References Cited

U.S. PATENT DOCUMENTS 5,436,634 A * 7/1995 Kanazawa ..... 345/67
5,912,651 A * 6/1999 Bitzakidis et al. ..... 345/58
6,034,482 A * 3/2000 Kanazawa et al. ..... 315/169.4
6,097,357 A * 8/2000 Shinoda et al. ..... 345/63
6,104,362 A * 8/2000 Kuriyama et al. ..... 345/63
6,337,674 B1 * 1/2002 Kim ..... 345/66
6,424,325 B1 * 7/2002 Van Dijk ..... 345/60

FOREIGN PATENT DOCUMENTS

EP 0549275 B1 6/1993 ..... G09G/3/28
JP 8123355 5/1996 ..... G09G/3/20

* cited by examiner

*Primary Examiner*—Bipin Shalwala
*Assistant Examiner*—Mansour M. Said

(57) ABSTRACT

A method of displaying an interlaced video signal (VS) on a matrix display panel (1) which is sub-field and interlaced driven and comprises a first and a second display field (Df1, Df2) forming interlaced display lines (Di), said interlaced video signal (Vs) having frames with a first and a second video field (Vf1, Vf2). During the frame period (Tfr) of the video signal (Vs), at least a first and a second display period (Td1, Td2) are generated. During each display period (Td1, Td2), the first and the second display field (Df1, Df2) are alternately selected for displaying video information related to the first and the second video field (Vf1, Vf2), respectively. The sub-field weights associated with the first and the second display field (Df1, Df2) of the first display period (Td1) differ by at least one weight from sub-field weights associated with the first and the second display field (Df1, Df2) of the second display period (Td2).

5 Claims, 4 Drawing Sheets

DISPLAYING INTERLACED VIDEO ON A MATRIX DISPLAY

BACKGROUND OF THE INVENTION

The invention relates to a method of displaying an interlaced video signal with frames of a first and a second video field on a matrix display panel which is sub-field and interlaced driven. The invention further relates to a circuit for displaying an interlaced video signal on a sub-field and interlaced driven matrix display panel. The invention also relates to a matrix display device comprising such a matrix display panel.

An interlaced video signal has a frame period with a first and a second video field period. Usually, the odd lines of the video signal form the first video field, and the even lines of the video signal form the second video field. When this interlaced video signal has to be displayed on the ALIS PDP, the odd lines of the video signal are displayed on the odd display lines, and the even lines of the video signal are displayed on the even display lines. Usually interlaced video signals have field rates of 50 Hz or 60 Hz, and thus frame rates of 25 Hz or 30 Hz, respectively, which gives rise to line flicker.

SUMMARY OF THE INVENTION

It is, inter alia, an object of the invention to reduce the line flicker.

To this end, a first aspect of the invention provides a method of displaying an interlaced video signal with frames of a first and a second video field on a matrix display panel which is sub-field and interlaced driven as claimed in claim 1. A second aspect of the invention provides a circuit for displaying an interlaced video signal on a sub-field and interlaced driven matrix display panel as claimed in claim 4. A third aspect of the invention provides a matrix display device comprising such a matrix display panel and such a circuit as claimed in claim 5. Advantageous embodiments are defined in the dependent claims.

In the prior art, each video field of the interlaced video signal is displayed on the corresponding display field during a video field period. It is known to generate the gray scales of the displayed video by driving the PDP in a sub-field mode. During each display field a number of sub-fields is generated, each sub-field comprising a prime period and a sustain period. During the prime period, a select driver selects the display lines (rows) one by one to prime the display cells of the selected row with data signals. The data signals are supplied in parallel by a data driver which receives the video signal Vs. During the sustain period, the select driver supplies pulses to all the rows associated with the active display field. The plasma channels are ignited a predetermined number of times to generate light from the pixels primed to do so. The amount of light produced depends on the number of ignitions. Sustain periods with a different number of ignitions are associated with the different sub-fields in a display field period. The amount of light generated during a display field is the sum of the different amounts of light produced during the sub-fields of this display field. The PDP is able to produce gray scales because, during the priming period of each sub-field, it is possible to select whether a certain pixel has to produce light during the subsequent sustain period or not. Each sub-field or each display field comprises an erase period. During the erase period, all pixels associated with the display field are erased. Detailed information on the sub-field operation of a PDP can be found in EP-B-0549275, which is herein incorporated by reference.

In accordance with the invention, at least a first and a second display period are generated during the frame period of the video signal. During each display period, the first and the second display field are alternately selected for displaying information related to the first and the second video field, respectively. The sub-field weights associated with the first and the second display fields of the first display period differ by at least one weight from the sub-field weights associated with the first and the second display field of the second display period. Thus, within one video frame period, the amount of light produced with respect to the video signal occurring during one video field period is now spread across at least two display fields which are separated by a display field with which another video field is associated. Consequently, the repetition frequency of light pulses associated with one video field increases and line flicker is reduced.

The sub-field weights associated with a first and a second display field of a certain display period may differ. The sub-field weights associated with different first or second display fields in a certain video frame period may be partly the same.

In an embodiment of the invention, two display periods or four display fields occur within one video frame period. During these four display fields, sub-fields are generated which are alternately associated with video information of a first and a second video field, respectively.

In the prior art, eight sub-fields with different binary weights are used to obtain 256 gray levels per color. The following example elucidates this embodiment of the invention by defining the sub-fields generated during one video frame period with four display fields. During the first display field, the video signal of the first video field is displayed by generating six sub-fields with the least significant weights. During the second display field, the video signal of the second video field is displayed by again generating six sub-fields with the least significant weights. During the third display field, the video signal of the first video field is displayed by generating six sub-fields with the most significant weights. During the fourth display field, the video signal of the second video field is displayed by generating six sub-fields with the most significant weights.

In an embodiment of the invention, the sub-field weights associated with the first display fields in a video frame period are substantially evenly distributed across all first display fields. As an example, four display fields are generated during one video frame period, a total of eight binary weighted sub-fields is associated with one video field, and four sub-fields occur during each display field. The weights of the eight sub-fields are 1, 2, 4, . . . , 128. As a first example, the weights 1, 4, 16, 64 are associated with the first and the second display field, and the weights 2, 8, 32, 128 are associated with the third and the fourth display field. As a second example, the weights 1, 2, 4, 128 are associated with the first and the second display field, and the weights 8, 16, 32, 64 are associated with the third and the fourth display field.

These and other aspects of the invention will be apparent from and elucidated with reference to the embodiments described hereinafter.

DESCRIPTION OF THE PREFERRED EMBODIMENTS

Figure 1:
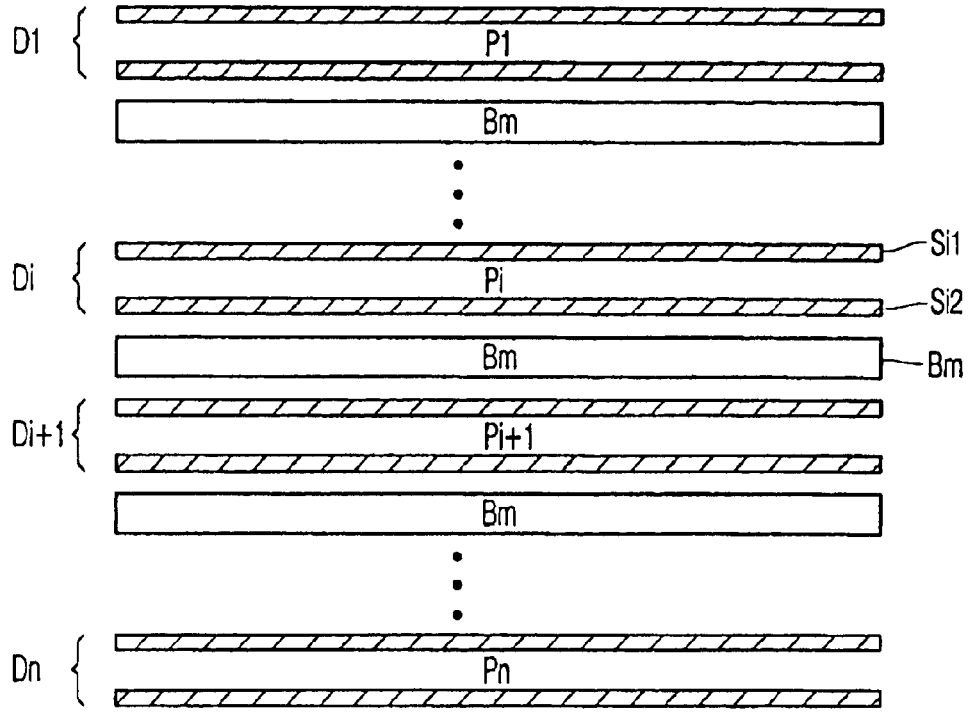
FIG. 1 shows part of the structure of a known progressively scanned PDP.

FIG. 1 shows part of the structure of a known progressively scanned PDP with n display lines D1, . . . , Dn. Each display line Di comprises a plasma channel Pi with which two spaced apart select electrodes Si1, Si2 are aligned. A display line Di is selected to prime associated pixels Cij (see FIG. 4) by supplying a sufficiently high voltage between the two electrodes Si1, Si2. A line of black matrix material Bm separates two consecutive plasma channels Pi, Pi+1.

Because two select electrodes Si1, Si2 are associated with one plasma channel Pi only, it is possible to activate neighboring plasma channels Pi independently of each other. This provides a progressive scan of the plasma channels Pi whereby the plasma channels Pi are activated successively one by one. Detailed information on such a PDP panel and the driving thereof can be found in EP-B-0549275.

Figure 2:
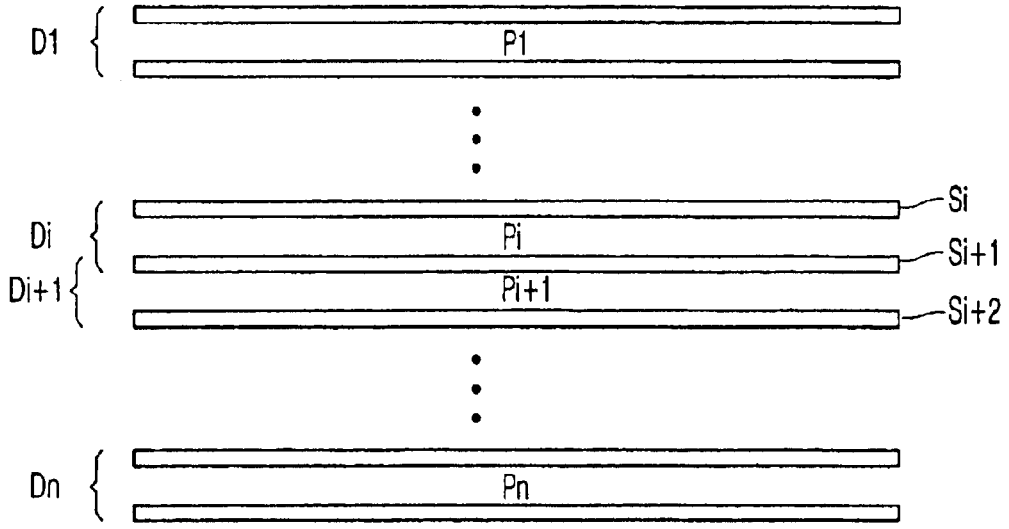
FIG. 2 shows part of the structure of the known ALIS PDP.

FIG. 2 shows part of the structure of the known ALIS PDP. In the ALIS PDP with n display lines D1, . . . , Dn, each display line Di comprises a plasma channel Pi with which two spaced-apart select electrodes Si, Si+1 are aligned. Again, a display line Di is selected by supplying a sufficiently high voltage between the two electrodes Si, Si+1. Two consecutive plasma channels Pi, Pi+1 have one electrode Si+1 in common. The display lines Di are selected in an interlaced sequence to provide a one-by-one selection of all display lines Di of this ALIS PDP. First, during a first field of display lines, the n/2 odd display lines Di are selected one by one, then, during a second field of display lines, the n/2 even display lines Di are selected one by one.

The addressing of the known ALIS PDP is elucidated with respect to FIG. 3, FIG. 4 and FIGS. 5A–D.

Figure 3:
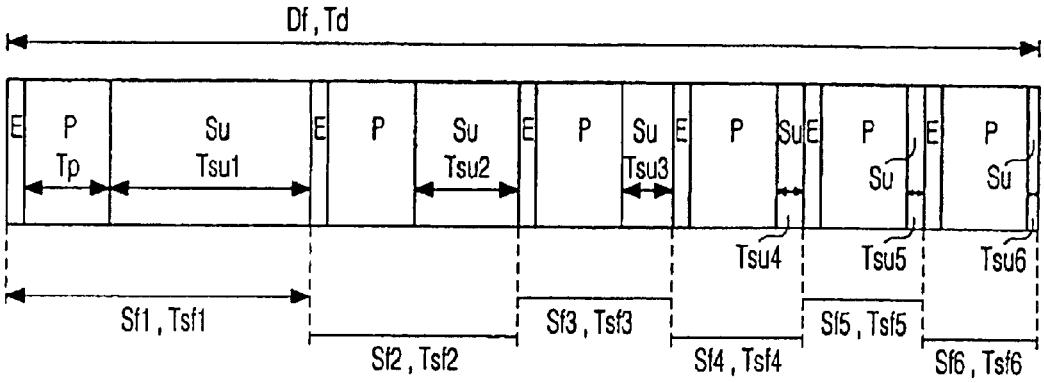
FIG. 3 Prior Art
FIG. 3 shows sub-fields generated during a display field in accordance with the prior art.

FIG. 3 shows sub-fields Sfi generated during a display field Df with duration Td, in accordance with the prior art. The display field Df is formed by the odd or the even display lines Di only. As an example, six sub-fields Sf1 to Sf6 are shown with binary weights $w1=2^0$ to $w6=2^5$ and a duration Tsf1 to Tsf6, respectively. Each sub-field Sfi has an erase period E, a prime period P with a duration Tp, and a sustain period Su with a duration Tsu1 to Tsu6, respectively.

Figure 4:
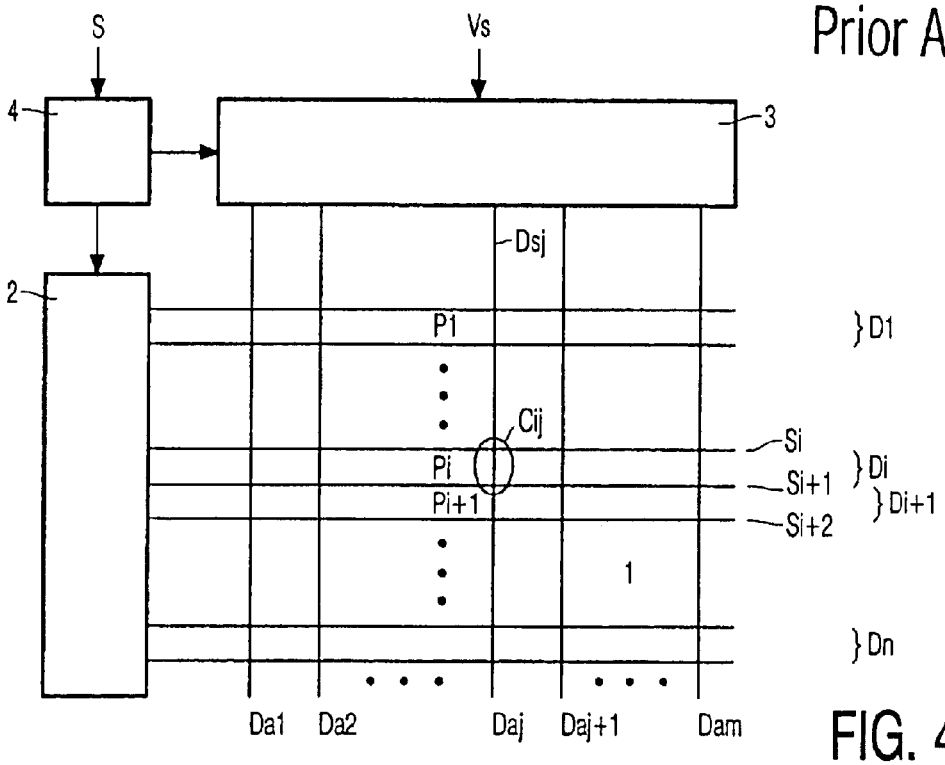
FIG. 4 shows a block diagram of a circuit for displaying a video signal on the ALIS PDP.

FIG. 4 shows a block diagram of a circuit for displaying a video signal Vs on the ALIS PDP 1. The ALIS PDP 1 shown comprises plasma channels Pi extending in the horizontal direction. Two select electrodes Si, Si+1 are associated with each plasma channel Pi. Data electrodes Daj extend in the vertical direction. Overlapping regions of the plasma channels Pi and the data electrodes Daj form display cells or pixels Cij, one of which is indicated by a circle.

It is known to display an interlaced video signal Vs with a first and a second video field on the ALIS PDP 1 by displaying the first video field on the first field of display lines Di, and the second video field on the second field of display lines. For example, the odd lines of the video signal Vs are displayed on the odd display lines, and the even lines of the video signal are displayed on the even display lines. During the prime period P, the timing circuit 4 commands the select driver 2 to select the display lines Di forming the display field Df one by one. For each selected display line Di, the timing circuit 4 commands the data driver 3 to supply the video signal Vs of the video line corresponding to the display line Di as parallel data signals Dsj to the data electrodes Da1 to Dam. The parallel data signals Dsj are in conformance with the weight of the sub-field Sfi. Consequently, each pixel Cij is primed with a certain amount of charge which depends on whether this pixel Cij has to produce light during the succeeding sustain period Su or not. During each sustain period Su, the timing circuit 4 commands the select driver 2 to supply sustain pulses to all the select electrodes S associated with display lines Di of the active display field Df for igniting the plasma associated with pixels Cij that are primed to produce light. The amount of light produced depends on the number of sustain pulses generated. During each erase period E, the charges of all pixels Cij of the display field Df are made equal to the sane start value. During each video field, one display field Df is generated with eight sub-fields Sf.

The timing circuit 4 receives the horizontal and vertical synchronization signals S of the video signal Vs to produce the timing signals for the select driver 2 and the data driver 3.

FIGS. 5A–D show voltages supplied to the select electrodes Si of the ALIS PDP to obtain the interlaced scan. In all FIGS. 5, voltages are denoted by a number 0, 1, −1, −2 to indicate the polarity and the relative value of the voltage concerned. For the sake of simplicity, an ALIS PDP with only a few select electrodes Si (S1 to S12), data electrodes Daj (Da1 to Da6), and display lines Di (D1, . . . , D11) is shown. The voltages supplied to the odd select electrodes S1, S3, . . . , S11 are shown to the left of the PDP. The even select electrodes S2, S4, . . . , S12 are interconnected in two groups, the voltages supplied to these two groups are shown to the right of the PDP. The data voltages Dsj are shown below the PDP. In a selected display line Di, pixels Cij which are primed to generate light are indicated by a solid circle, pixels Cij which are primed to not produce light are indicated by a dashed circle.

Figure 5A:
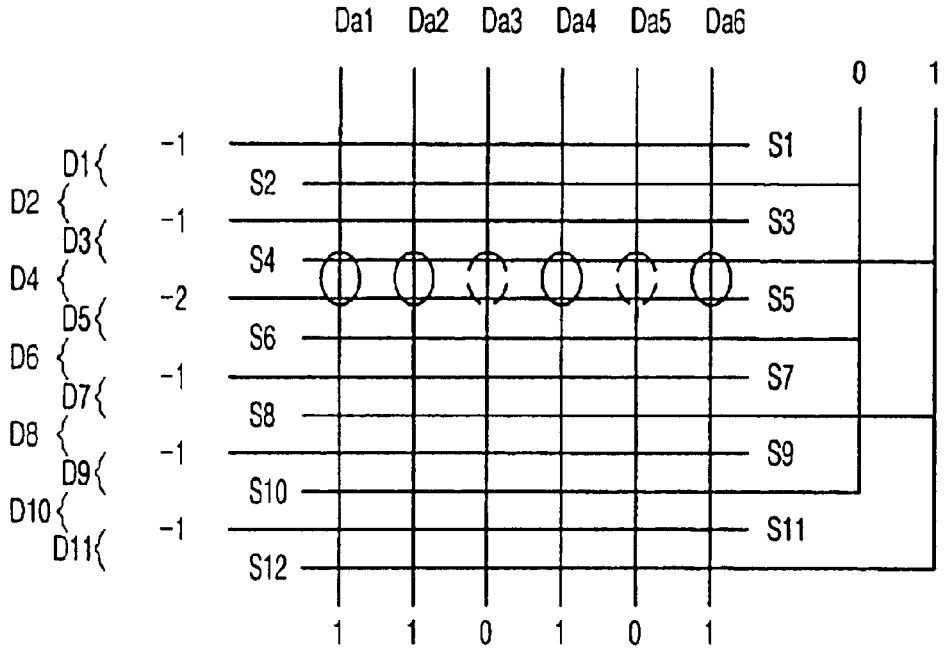
FIGS. 5A–D show voltages supplied to the select electrodes of the ALIS PDP to obtain an interlaced scan.
Figure 5B:
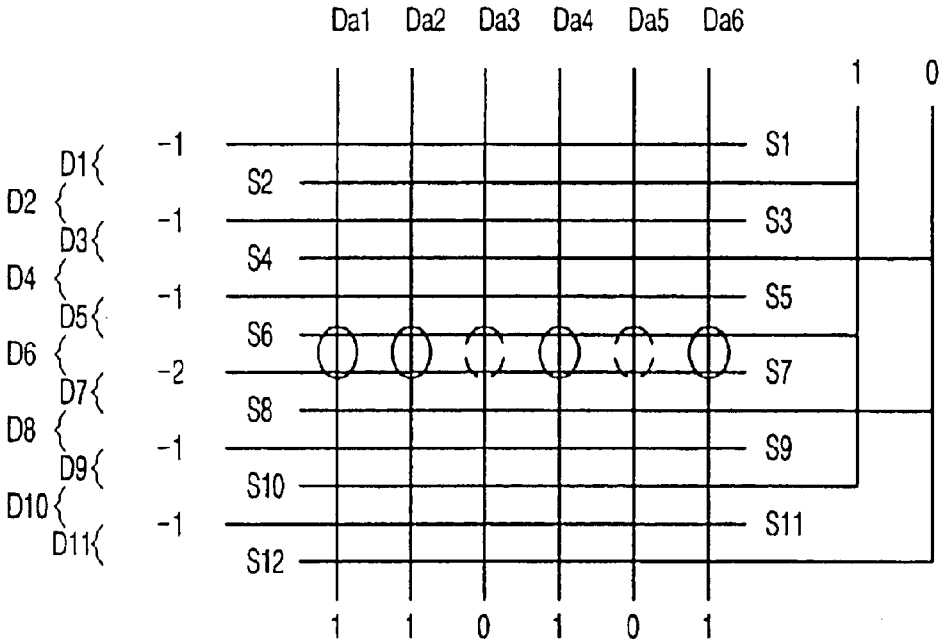
Figure 5C:
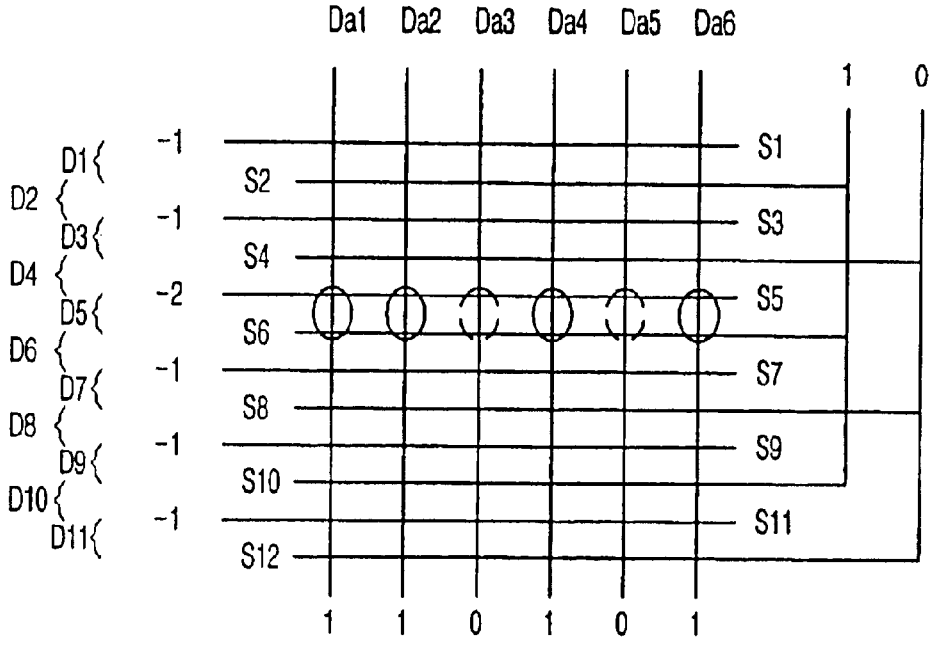
Figure 5D:
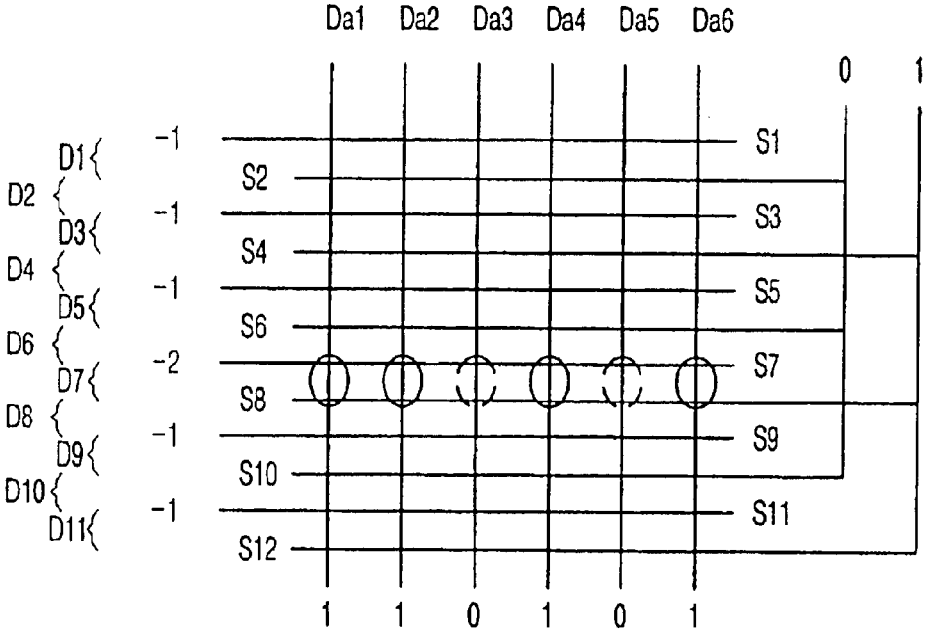

FIG. 5A shows the voltages to select display line D4 during a certain display field. FIG. 5B shows the voltages to select display line D6 during this certain display field. FIG. 5C shows the voltages to select display line D5 during a succeeding display field, and FIG. 5D shows the voltages to select display line D7 during this succeeding display field.

It is possible to select the display lines Di of a certain display field in different ways. As an example, this is explained with respect to FIGS. 5A and 5B. All even rows D2, D4, . . . , D10 way be selected one by one by first selecting a certain row, let us assume D4, in accordance with FIG. 5A. Next, the consecutive even row D6 is selected as shown in FIG. 5B. Then, the even row D8 is selected in accordance with FIG. 5A by applying a −1 voltage to select electrode S5 and a −2 voltage to select electrode S9. Next, the even row D10 is selected in accordance with FIG. 5B by applying a −1 voltage to select electrode S7 and a −2 voltage to the select electrode S11. And so on. This selection scheme has the disadvantage that the voltages on the even select electrodes have to change for every display line Di, which causes a large dissipation. This drawback is prevented by first selecting the rows D4, D8 in accordance with FIG. 5A and next the rows D2, D6, D10 in accordance with FIG. 5B. In the same way, it is possible to select the odd display rows Di first in accordance with FIG. 5C and next in accordance with FIG. 5D.

Figure 6:
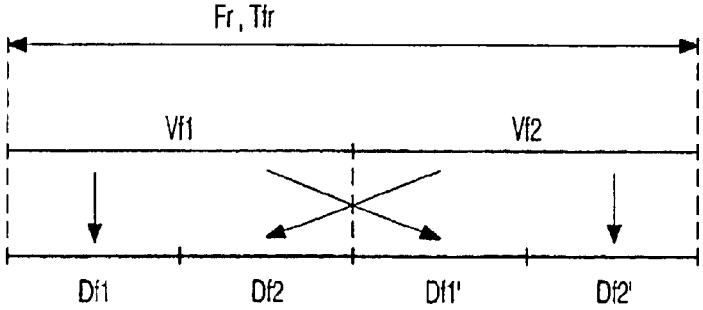
FIG. 6 shows how the video fields are displayed on display fields in an embodiment in accordance with the invention.

FIG. 6 shows how the video fields Vf1, Vf2 of an interlaced video signal Vs are displayed on display fields Df1, Df1', Df2, Df2' in an embodiment in accordance with the invention.

One video frame Fr lasts a frame period Tfr which comprises two video fields Vf1 and Vf2, each with n video lines. One of the video fields Vf1, Vf2 comprises the odd video lines, the other video field comprises the even video lines. In the prior art, each video field Vfi is displayed on one associated display field Di with eight sub-fields Sfi. The sub-fields Sfi have different sub-field weights. In accordance with the embodiment of the invention as shown in FIG. 6, four display fields Df1, Df2, Df1', Df2' are generated during the frame period Tfr. Four sub-fields Sfi are generated during each display field Df1, Df2, Df1', Df2'. The eight sub-fields Sfi associated with the first video field Vf1 are distributed across the display fields Df1 and Df1', and the eight sub-fields Sfi associated with a succeeding second video field Vf2 are distributed across the display fields Df2 and Df2'.

The timing circuit 4 as shown in FIG. 4 has to be adapted to select a display field Dfi in less than half a video field period. As now only four sub-fields Sfi have to be displayed during a display field Dfi, the timing of the select driver 2 and the data driver 3 is substantially the same as for the known ALIS PDP. If more than four sub-fields are displayed during half a video field period, the sustain frequency has to be increased and/or the number of sustain pulses has to be decreased. The timing circuit 4 has to be adapted to control the data driver 3 to supply the data signals Dsj in an order fitting the order of sub-field weights. The timing circuit 4 may comprise a microprocessor to control the timings.

The same way of driving the ALIS PDP can be used for progressively scanned video. For example, let us assume that a 1024-line SXGA video signal has to be displayed on the ALIS display with about 1024 display lines Di. It is possible to only display the odd or even video lines on only the odd or even display lines Di. This has the drawback that only half the resolution is displayed. It is possible to display the odd video lines on the odd display lines and the even video lines on the even display lines. This has the drawback that line flicker occurs. It is further possible to use the display scheme in accordance with the present invention. Within one field period of the progressive video, four display fields are generated. During the first and the third display field the odd video lines are displayed on the odd display lines. During the second and the fourth display field, the even video lines are displayed on the even display lines. It is of course possible to interchange the order of even and odd lines. In this way, a full resolution is achieved without causing noticeable flicker. If it is not possible to obtain sufficient light output when eight sub-fields are generated in the display period, the number of sub-fields per display period may be decreased. For a computer-generated image, this has the effect that fewer gray scales are generated per color, which is more acceptable than a loss of half the resolution, or line flicker.

In an embodiment of the invention, motion compensation is performed to reduce the motion artifacts caused by the fact that the light output of different sub-fields Sfi occurs at different instants. Motion compensation schemes as such are well known in the prior art, for example from JP-A-8-123355, which is herein incorporated by reference. This prior art discloses a plasma display panel wherein gray scales are displayed by using the sub-field drive mode. The quantity and the direction of movement of an image displayed within one field period are detected at each bit. A movement correction quantity is determined on the basis of the detected values and on a division period ratio of a sub-field duration and the display period. The image on the corresponding sub-field is moved in the detected direction to prevent dislocation of the display position at each bit when the human eye tracks the moving image.

It should be noted that the above-mentioned embodiments illustrate rather than limit the invention, and that those skilled in the art will be able to design many alternative embodiments without departing from the scope of the appended claims. The embodiments describe an ALIS PDP with plasma channels extending in the horizontal direction. Alternatively, the PDP may be rotated through 90°, such that the plasma channels extend in the vertical direction. The plasma channels may be open towards each other, such that a layer of plasma exists. Instead of plasma channels, the PDP may comprise plasma cells. Although embodiments of the invention are elucidated with respect to a plasma display panel, the invention is also usable in other sub-field driven matrix displays.

In the claims, any reference signs placed between parentheses shall not be construed as limiting the claim. The word "comprising" does not exclude the presence of other elements or steps than those listed in a claim. The invention can be implemented by means of hardware comprising several distinct elements, and by means of a suitably programmed computer. In the device claim enumerating several means, several of these means can be embodied by one and the same item of hardware.

What is claimed is:

1. A method of displaying a video signal on a matrix display panel, said panel being sub-field and interlaced driven, with first and second display fields forming interlaced display lines, said video signal having frames with respective frame periods and first and second video fields, said method comprising:

generating at least first and second display fields representative of the first and second video fields, each of said first and second display fields comprising a respective plurality of weighted sub-fields;

for each frame period of the video signal, generating a first and second display period;

during each of the first and second display periods, alternately generating a part of the first display field and a part of the second display field, said parts of the first display field and the second display field including non-identically weighted ones of the sub-fields of said first and second display fields.

2. The method as in claim 1, including two display periods for each frame period, each of the first and second display fields including at least four sub-fields.

3. The method as in claim 1, wherein the sub-field weights for the first display field of each frame are substantially evenly distributed across each frame period.

4. A circuit for displaying a video signal on a matrix display panel, said panel being sub-field and interlaced driven, with first and second display fields forming interlaced display lines, said video signal having frames with respective frame periods and first and second video fields, said circuit comprising:

means for generating at least first and second display fields representative of the first and second video fields, each of said first and second display fields comprising a respective plurality of weighted sub-fields;

means for generating a first and second display period for each frame period of the video signal; and means for alternately generating a part of the first display field and a part of the second display field during each of the first and second display periods, said parts of the first display field and the second display field including non-identically-weighted ones of the sub-fields of said first and second display fields.

5. A matrix display device, comprising:

a matrix display panel;

a circuit for displaying a video signal on the matrix display panel, said panel being sub-field and interlaced driven, with first and second display fields forming interlaced display lines, said video signal having frames with respective frame periods and first and second video fields, said circuit comprising:

means for generating at least first and second display fields representative of the first and second video fields, each of said first and second display fields comprising a respective plurality of weighted sub-fields;

means for generating a first and second display period for each frame period of the video signal; and means for alternately generating a part of the first display field and a part of the second display field during each of the first and second display periods, said parts of the first display field and the second display field including non-identically-weighted ones of the sub-fields of said first and second display fields.

* * * * *